US005709981A

United States Patent [19]

Szajewski

[11] Patent Number: 5,709,981

[45] Date of Patent: Jan. 20, 1998

[54] PHOTOGRAPHIC MATERIAL AND PROCESS UTILIZING HIGH CHLORIDE TABULAR GRAIN SILVER HALIDE EMULSIONS WITH (111) CRYSTALLOGRAPHIC FACES

[75] Inventor: Richard Peter Szajewski, Rochester, N.Y.

[73] Assignee: Eastman Kodak Company, Rochester, N.Y.

[21] Appl. No.: 625,622

[22] Filed: Mar. 29, 1996

Related U.S. Application Data

[60] Provisional application No. 60/002,980, Aug. 30, 1995.

[51] Int. Cl.[6] ..... G03C 7/407; G03C 1/035

[52] U.S. Cl. ..... 430/375; 430/567

[58] Field of Search ..... 430/567, 569, 430/375

[56] References Cited

U.S. PATENT DOCUMENTS

| | | | |
|---|---|---|---|
| 4,952,491 | 8/1990 | Nishikawa et al. | 430/570 |
| 5,035,992 | 7/1991 | Houie et al. | 430/569 |
| 5,061,614 | 10/1991 | Takada et al. | 430/569 |
| 5,217,858 | 6/1993 | Maskasky | 430/567 |
| 5,264,337 | 11/1993 | Maskasky | 430/567 |
| 5,298,388 | 3/1994 | Maskasky | 430/569 |
| 5,314,798 | 5/1994 | Brust et al. | 430/567 |
| 5,320,938 | 6/1994 | House et al. | 430/567 |
| 5,389,509 | 2/1995 | Maskasky | 430/567 |
| 5,508,160 | 4/1996 | Maskasky | 430/567 |

*Primary Examiner*—Mark F. Ruff

*Attorney, Agent, or Firm*—Paul A. Leipold

[57] ABSTRACT

The invention relates to a light sensitive photographic element comprising a support, and chemically and spectrally sensitized emulsions (A) and (B), wherein:

emulsion (A) comprises a tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in said core, said band containing up to about 30 percent of the silver in the tabular grain;

wherein said emulsion (A) has been precipitated in the presence of an organic grain growth modifier or surface stabilizer and wherein said organic grain growth modifier or surface stabilizer has been substantially removed from said emulsion (A) after the formation of said band; and emulsion (B) comprises at least 50 mole percent chloride, based on silver, and is bounded by {100} major faces.

24 Claims, No Drawings

PHOTOGRAPHIC MATERIAL AND PROCESS UTILIZING HIGH CHLORIDE TABULAR GRAIN SILVER HALIDE EMULSIONS WITH (111) CRYSTALLOGRAPHIC FACES

CROSS REFERENCE TO RELATED APPLICATION

Reference is made to and priority claimed from U.S. Provisional Application Ser. No. 60/002,980, filed 30 Aug. 1995, entitled PHOTOGRAPHIC MATERIAL AND PROCESS UTILIZING HIGH CHLORIDE TABULAR GRAIN SILVER HALIDE EMULSIONS WITH {111} CRYSTALLOGRAPHIC FACES.

FIELD OF THE INVENTION

This invention relates to a light sensitive photographic element employing bromide or iodide stabilized high chloride {111} tabular grain emulsions exhibiting improved image sharpness and to methods of processing such elements.

BACKGROUND OF THE INVENTION

High iodobromide tabular grain silver halide emulsions with {111} crystallographic faces are known to provide an improved balance of sensitivity and granularity along with improved image sharpness as described by Kofron et al U.S. Pat. No. 4,439,520. The predominately iodobromide emulsions described by Kofron, are, however, slow to develop and can be difficult to adequately bleach and fix when employed in color forming elements.

Attempts have been made to provide emulsions exhibiting all the desirable characteristics described by Kofron, particularly excellent photographic sensitivity, while simultaneously providing improved developability and improved bleaching and fixing behavior by replacing some or all of the bromide and iodide ion of these emulsions with chloride ion. These early high chloride emulsions, while generally successful, required the presence of a substituted hydrocarbon grain growth modifier to both enable growth of the morphologically unstable {111} form and to stabilize that form once present. Nevertheless, these emulsions still suffered from a lack of morphological stability which limited their commercial utility because the emulsion dependent photographic properties would change drastically over time. Subsequently, attempts at providing high chloride {111} tabular emulsions have focused on improved grain growth modifiers and methods of morphological stabilization by providing various organic compounds which serve to better direct grain growth towards {111} tabular forms and to stabilize the grain surface as described, inter alia, at Jones, U.S. Pat. No. 5,176,991, Maskasky, U.S. Pat. No. 5,176,992 or Nishikawa, U.S. Pat. No. 4,952,491. Neither Jones nor Maskasky makes any specific teaching about preferred color development methods, while Nishikawa teaches the use of developer solutions containing little to no bromide ion. While the the grain growth control and morphological stability of the high chloride {111} tabular emulsions have been greatly advanced by these techniques, those emulsions with well-adhered organic surface stabilizer when coated in a photographic element still prove difficult to adequately develop and desilver, while those emulsions with poorly adhered or purposefully removed organic surface stabilizer still suffer from morphological instability. More recently, it has been reported by Houle et al, U.S. Pat. No. 5,035,992, that improved morphological stability can be achieved with high chloride {111} grains of various morphologies by the expedient of incorporating a bromide or iodide band. Additional examples of bromide or iodide stabilized {111} high chloride tabular grain emulsions are illustrated at Maskasky, U.S. Pat. Nos. 5,217,858 and 5,389,509. The emulsions described in these publications still require the presence of a grain growth modifier to ensure formation of the {111} faced tabular shaped grains. Further, the application of these emulsions to camera speed color negative films is not described.

PROBLEM TO BE SOLVED BY THE INVENTION

Unfortunately, while the morphological stability and desilvering properties of these bromide or iodide surface stabilized, {111} high chloride tabular grain emulsions are much improved over the earlier variants, the image sharpness obtained in photographic elements employing such otherwise acceptable emulsions as the light sensitive element is still far from adequate. For this reason, an unmet need exists to provide a light sensitive photographic element incorporating {111} high chloride tabular grain emulsions exhibiting excellent sharpness, and to provide such an element in a way that does not degrade the stability, developability and desilvering characteristics typically sought by those who employ such an emulsion.

SUMMARY OF THE INVENTION

It has now been discovered that this goal, along with many others that will become obvious, can be met by providing:

a light sensitive photographic element comprising a support, one or more silver halide emulsion layers and chemically and spectrally sensitized emulsions (A) and (B), wherein:

emulsion (A) comprises a tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in said core, said band containing up to about 30 percent of the silver in the tabular grain;

wherein said emulsion (A) has been precipitated in the presence of an organic grain growth modifier or surface stabilizer and wherein said organic grain growth modifier or surface stabilizer has been substantially removed from said emulsion (A) after the formation of said band; and emulsion (B) comprises at least 50 mole percent chloride, based on silver, and is bounded by {100} major faces.

In a preferred embodiment, this goal is met by providing:

a light sensitive photographic element comprising a support one or more silver halide emulsion layers, and emulsions (A) and (B), wherein:

emulsion (A) comprises a chemically and spectrally sensitized tabular grain silver halide emulsion population comprised of at least 50 mole percent chloride and no more than about 2 mole percent iodide, based on silver, wherein at least 50 percent of the grain population projected area is accounted for by tabular grains bounded by {111} major faces, each having an aspect ratio of at least 2, and each being comprised of a core and a surrounding band containing a higher level of iodide ion than is present in said core, said band containing up to about 30 percent of the silver in the tabular grain;

wherein said emulsion (A) has been precipitated in the presence of an organic grain growth modifier or surface stabilizer and wherein said organic grain growth modifier or surface stabilizer has been removed from said emulsion (A) after the formation of said band; and emulsion (B) comprises a chemically and spectrally sensitized silver halide emulsion population comprised of at least 50 mole percent chloride and no more than about 2 mole percent iodide, based on silver, wherein at least 50 percent of the grain population projected area is accounted for by tabular grains bounded by {100} major faces, each having an adjacent edge ratio of less than 10 and an aspect ratio greater than 2, and each being comprised of a core and a surrounding band containing a higher level of bromide or iodide ion than is present in said core, said band containing up to about 30 percent of the silver in the grain; and wherein said element comprises a red light-sensitive color record comprised of a red sensitized silver halide emulsion in reactive association with a cyan dye forming image coupler, a green light-sensitive color record comprised of a green sensitized silver halide emulsion in reactive association with a magenta dye forming image coupler, and a blue light-sensitive color record comprised of a blue sensitized silver halide emulsion in reactive association with a yellow dye forming image coupler;

said element comprises a development inhibitor releasing compound; and said element has a light sensitivity of at least ISO-25.

In another preferred mode, the improvements of this invention can be achieved by providing:

an image forming process comprising the step of contacting an imagewise exposed light sensitive photographic element with a developing solution;

said element comprising a support, one or more silver halide emulsion layers and chemically and spectrally sensitized emulsions (A) and (B), wherein:

emulsion (A) comprises a tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in said core, said band containing up to about 30 percent of the silver in the tabular grain;

wherein said emulsion (A) has been precipitated in the presence of an organic grain growth modifier or surface stabilizer and wherein said organic grain growth modifier or surface stabilizer has been removed from said emulsion (A) after the formation of said band; and emulsion (B) comprises at least 50 mole percent chloride, based on silver, and is bounded by {100} major faces; and the contact time of said element with said developing solution is between about 10 and 120 seconds; and said developing solution is characterized in that:

(1) the solution temperature is between about 25° and 65° C.;

(2) the solution comprises bromide ion at a concentration of between about 0.25 and 50 mmol per liter;

(3) the solution comprises a color developing agent at a concentration between about 1 and 200 mmol per liter;

(4) the ratio of developing agent concentration to bromide ion concentration is between about 60:1 and 1:2; and (5) the solutuion pH is between about 9 and 12.

ADVANTAGEOUS EFFECT OF THE INVENTION

This invention provides a light sensitive photographic element employing high chloride {111} tabular grain emulsions exhibiting greatly improved image sharpness. The elements employing these tabular emulsions exhibit excellent photographic sensitivity. The {111} emulsions are surface stabilized, thus providing for excellent keeping properties for both the emulsions themselves and for film elements employing the emulsions. These elements simultaneously allow for both improved development and greatly improved desilvering, thus allowing the speedy attainment of high quality images. Specific methods of developing such elements are additionally provided.

DETAILED DESCRIPTION OF THE INVENTION

Emulsion (A) useful in the practice of this invention comprises a chemically and spectrally sensitized tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in said core, said band containing up to about 30 percent of the silver in the tabular grain.

These grains have well-defined exterior crystal faces that lie in {111} crystallographic planes which are substantially parallel and the overall grain shape is tabular. Tabular grains are preferred in the practice of this invention since they provide improved sensitivity relative to the related {111} octahedral shaped or other {111} grains also known in the art. The tabular grains generally have a thickness of 0.5 microns or less, and preferably have a thickness of less than about 0.3 microns. Ultra-thin grains limited in thickness only by having a thickness of greater than about 0.01 micron are specifically contemplated. The grains will generally have a diameter of less than about 10 microns and preferably have a diameter of less than about 7 microns. Generally, grain diameters of greater than about 0.2 microns are useful, while diameters of greater than about 0.4 microns are preferred. The term "aspect ratio" refers to the ratio of the diameter of the grain to the thickness of the grain. The grains must have an aspect ratio of greater than about 2 and preferably have an aspect ratio greater than about 8. It is preferred that the aspect ratio be less than about 100. Tabular grains can also be defined by their Tabularity which is the ratio of the diameter to the square of the grain thickness. The emulsions useful in the practice of this invention will generally have a Tabularity greater than about 5 and preferably greater than about 25. The Tabularity will generally be less than about 15,000, preferably less than about 5,000, and most preferably less than about 1,000.

The grain shape criteria described above can be readily ascertained by procedures well known to those skilled in the art. For example, it is possible to determine the diameter and thickness of individual grains from shadowed electron micrographs of emulsion samples. The diameter of a tabular grain refers to the diameter of a circle equal in area to the projected area of that tabular grain. This diameter is often described colloquially as an equivalent circular diameter (ECD). Generally a tabular grain has two parallel faces, and the thickness of the grain refers to the distance between the two parallel faces. The halide content of individual grains can be determined by well-known microprobe techniques, while the halide content of an emulsion population generally follows from the details of precipitation and sensitization and can be verified by microprobe, atomic absorption, or x-ray fluorescence techniques. From these measurements, the proportion of grains in an emulsion sample fulfilling the requirements of this invention can be determined. The average equivalent circular diameter of the grains in an emulsion sample is the average of the individual equivalent circular diamters of the grains in that sample. In the same vein the average grain thickness is the average of the grain thickness of the individual grains, the average aspect ratio is the average of the individual aspect ratios, and the average Tabularity is the average of the individual Tabularities. Such electron micrographs of {111} tabular emulsions when viewed face-on generally have the appearance of hexagons or tip-truncated hexagons of greater or lesser regularity. It is preferred that the coefficient-of-variation in the ECD or thickness of the grains in a useful emulsion population be less than about 60%, and preferably less than about 30%, as this provides improved tone scale, image granularity behavior, and other properties as described in the art.

In the context of this invention, a band refers both to a localized surface layer of silver halide deposited in a continuous fashion on a pre-formed silver halide grain core. When the band is deposited in a continuous fashion, it may fully enclose the core region, or alternatively, it may encircle the core region forming a continuous ring-like deposit localized along the grain edges, or again alternatively, it may form a continuous deposit on the grain faces. A core refers to the said pre-formed silver halide grain onto which the band in formed. The halide composition of the band and core regions of the grain are of different composition as dictated by the halide composition of the solutions used in the precipitation. The band is formed after at least 50 percent, but preferably 70 percent, or more preferably 90 percent of the grain formation reaction, that is the grain precipitation, is completed. When the higher silver bromide or silver iodide band is formed before all of the silver salt solution has been added, it may be followed by a region of lower silver bromide or silver iodide proportion. Alternatively, the band may be formed after all of the silver salt solution has been added by the addition of a second salt solution, wherein the solubility with silver ion of the second halide is sufficiently less than that of the first silver halide so that conversion of the surface silver halide layer will result. The grains may contain multiple bands around a central core and the bands may vary in the proportion of chloride, bromide, and iodide. While the band may contain up to about 30 percent of the silver in the tabular grain, it is preferred that the band contain between about 0.1 and 10 percent of the silver in the tabular grain, and even more preferred that the band contain between about 0.2 and 3 percent of the silver in the tabular grain.

The high chloride tabular {111} grains with the bromide or iodide band useful in the practice of this invention can be prepared by precipitation procedures known in the art, or by obvious modifications of such procedures. Typically these procedures include the addition of any grain growth modifier known in the art. These grain growth modifiers can preferentially be chosen from among: the aminoazapyridine type compounds described in U.S. Pat. Nos. 4,801,523 and 4,804,621; the amino- and diamino-substituted pyrimidine type compounds described in U.S. Pat. No. 5,035,992; the 4,6-di(hydroamino)-5-aminopyrimi-dine, 6-aminopurine, 4-aminopteridine, and 8-azaadenine type compounds disclosed in U.S. Pat. No. 5,217,858; and the 7-azaindole type compounds disclosed in U.S. Pat. No. 5,389,509, all incorporated herein by reference. These grain growth modifiers are often pH sensitive and may be removed from the grains after a precipitation by adjusting the pH of the precipitation medium, typically water and gelatin, and washing as known in the art. In another embodiment, the removable grain growth modifiers described at U.S. Pat. Nos. 4,952,490 and 4,952,491, both incorporated by reference, may be employed in conjunction with the oxidative grain growth modifier removal schemes suggested therein. Removal of the organic grain growth modifier is preferred for emulsions to be employed in the practice of this invention since this removal aids in the desilvering steps typically employed during photographic processing of the light sensitive elements. The presence of the bromide or iodide band incorporated in the silver halide grains during the precipitation promotes the morphological stability of the grains thus formed.

The organic grain growth modifier is preferentially substantially removed from the emulsion grain after the formation of the band or shelf. By substantially removed is meant that a sufficient proportion of grain growth modifier or stabilizer is removed so that the development or desilvering steps of photographic process is not hindered. This typically occurs when at least about 90% of the modifier or stabilizer is removed. It is preferred that at least 95% of the organic modifier or stabilizer be removed and more preferred that at least 98% or even 99% be removed.

While either bromide or iodide can be used to stabilize the grain surface, the use of iodide for this function is preferred since the iodide band provides superior morphological stability to the otherwise unstable {111} grains. Additionally bromide and/or iodide may be incorporated in the emulsion in any manner known in the art. In particular, iodide may advantageously be present or added during emulsion grain preparation, particularly during the grain nucleation and grain growth steps, and during grain sensitization. When bromide or iodide, or both, are added during a grain growth step or for the purposes of band formation, they may be added continuously as a halide run or may be added at discrete times as a halide dump. The halide may be supplied as soluble halide ion, as a sparingly soluble salt or by release from an organic carrier during an emulsion preparation step. Total emulsion iodide content should be less than about 5 mol percent, preferably less than about 2 mole percent, and most preferably less than about 1 mole percent iodide, based on silver, to ensure good development and desilvering characteristics. The remainder of the emulsion halide may be bromide which can be incorporated as described or in any manner known in the art. The emulsion may be chemically sensitized, doped, or treated with various metals and sensitizers as known in the art, including iron, sulfur, selenium, iridium, gold, platinum or paladium so as to modify or improve its properties. The emulsions can also be reduction-sensitized during the preparation of the grains by using thiourea dioxide and thiosulfonic acid according to the procedures in U.S. Pat. No. 5,061,614. The grains may be spectrally sensitized as known in the art.

Emulsion (B) useful in the practice of this invention is chemically and spectrally sensitized, comprises at least 50 mole percent chloride, based on silver, and is bounded by {100} major faces. Image formation and desilvering of the photographic element according to this invention are best carried out when the emulsion comprises greater than about 70 mole percent chloride and preferentially greater than about 95 mole percent chloride. A chloride content of greater than about 97 mole percent is even more preferred. Bromide or Iodide ion may be incorporated in the emulsion in any manner known in the art. In particular, iodide may advantageously be present or added during emulsion grain preparation, particularly during the grain nucleation and grain growth steps, and during grain sensitization. When bromide or iodide, that is halide, or both are added during a grain growth step, it may be added continuously as a halide run or may be added at discrete times as an halide dump. The halide may be supplied as soluble halide ion, as a sparingly soluble salt, or by release from an organic carrier during the emulsion preparation step. Total emulsion iodide content should be less than about 5 mol percent, preferably less than about 2 mole percent, and most preferably less than about 1 mole percent iodide, based on silver, so as to ensure good development and desilvering characteristics. The remainder of the emulsion halide may be bromide. The emulsion may be chemically sensitized, doped, or treated with various metals as known in the art, including iron, sulfur, selenium, iridium, gold, platinum or paladium compounds so as to modify or improve its properties. The emulsions can also be reduction-sensitized during the preparation of the grains by using thiourea dioxide and thiosulfonic acid according to the procedures in U.S. Pat. No. 5,061,614. The emulsion is spectrally sensitized as known in the art.

Tabular silver chloride grains having {100} major faces are especially preferred since these grains are morphologically stable, capable of being readily sensitized with a variety of sensitizing dyes, and they provide improved sensitivity relative to the related {100} regular shaped grains also known in the art. The tabular grains generally have a thickness of 0.5 microns or less, and preferably have a thickness of less than about 0.35 microns. Ultra-thin grains having a thickness of greater than about 0.01 micron are specifically contemplated. The grains will generally have a diameter of less than about 10 microns and preferably have a diameter of less than about 7 microns. Generally, grain diameters of greater than about 0.2 microns are useful, while diameters of greater than about 0.4 microns are preferred. The grains must have an aspect ratio of greater than about 2 and preferably have an aspect ratio greater than about 8. It is preferred that the aspect ratio be less than about 100. The emulsions useful in the practice of this invention will generally have a Tabularity greater than about 20 and preferably greater than about 50. The Tabularity will generally be less than about 10,000, preferably less than about 5,000, and most preferably less than about 1,000.

Silver chloride emulsions characterized by at least 50 percent of the grain population projected area being accounted for by tabular grains (1) bounded by {100} major faces having adjacent edge ratios of less than 10 and (2) each having an aspect ratio of at least 2 are especially preferred in the practice of this invention. The precipitation and chemical and spectral sensitization of such grains are disclosed by House et al at U.S. Pat. No. 5,320,938 and by Maskasky at U.S. Pat. Nos. 5,264,337, 5,275,930 and 5,292,632, the disclosures of which are incorporated by reference. Additional descriptions of the preparation, sensitization and use in multilayer multicolor light sensitive elements of such high chloride {100} tabular grains occur at Szajewski et al U.S. Pat. Nos. 5,310,635, and 5,356,764, at European Patent Applications 0,569,971A, 0,584,644A and 0,618,492A as well as at Japanese published applications JA 06/289,517A, 06/308,648A, the disclosures of which are incorporated by reference.

In an especially preferred embodiment, the {100} tabular grains include a core and a surrounding band containing a higher level of bromide or iodide ion than is present in said core, said band containing up to about 30 percent of the silver in the grain. While the band may contain up to about 30 percent of the silver in the tabular grain, it is preferred that the band contain between about 0.1 and 10 percent of the silver in the tabular grain, and even more preferred that the band contain between about 0.2 and 3 percent of the silver in the tabular grain. This band structure can be incorporated as described in the discussion of Emulsion (A) or as taught in the art. Banded iodide, high chloride {100} emulsions are described in detail by Brust et al, U.S. Pat. No. 5,314,798, the disclosures of which are incorporated by reference. Iodide bands are generally preferred to bromide bands because of the improved sensitivity achieved with iodide in this mode.

The light sensitive elements useful in the practice of this invention can be negative or positive working elements. In the preferred embodiment, the elements are negative working elements and are to be processed as negative working elements. These negative working elements are preferentially camera speed elements sufficiently light sensitive for use in a hand held camera, that is having a sensitivity of at least ISO-25, and preferably a sensitivity of at least ISO-100. In a less preferred mode they can be display elements, that is elements having a lower sensitivity and intended for direct viewing.

The elements will be sensitive to that portion of the electromagnetic spectrum generally described as actinic radiation, that is to red, green, blue, infrared, or ultraviolet light or to combinations thereof. Red or red light means actinic radiation or light of a wavelength of between about 600 and 700 nm, green or green light means light of a wavelength between about 500 and 600 nm, while blue or blue light means light with a wavelength of between about 400 and 500 nm. In the same vein, dyes which primarily absorb red light are referred to as cyan dyes, dyes which primarily absorb green light are referred to as magenta dyes, and dyes which primarily absorb blue light are referred to as yellow dyes. Unless otherwise indicated, dye densities are reported as Status M densities, the measurement of which is described at T. H. James, Ed., "The Theory of the Photographic Process," Macmillan, New York, 1977, 4th ed, page 520–521.

The camera speed color negative films useful in the practice of this invention typically comprise a support bearing a red light sensitive color record capable of forming a cyan dye deposit, a green light sensitive color record capable of forming a magenta dye deposit, and a blue light sensitive color record capable of forming a yellow dye deposit. Each color unit can be comprised of one layer or of two, three, four, or more discrete layers. The layers of a color unit can be contiguous or can be separated by non-light sensitive layers or by layers associated with a different color forming unit, all as known in the art. While the sensitivities of the individual color units are as described above, in a preferred mode, the blue sensitive layer has a broad sensitivity between about 440 and 480 nm, the green sensitive layer has narrow peak sensitivity between about 540 and 560 nm, and the red sensitive layer has a peak sensitivity between about 625 and 655 nm, with a peak between about 625 and 645 nm being especially preferred. The specific sensitivities are enabled by the use of spectral sensitizing dyes as known in the art. After imagewise exposure, chromogenic dye deposits will typically be formed during a development step which comprises contacting the color negative film with a basic solution and a paraphylene diamine color developing agent which reduces exposed silver halide to metallic silver and is itself oxidized. The oxidized color developing agent, in turn, reacts with a photographic coupler to form the chromogenic cyan, magenta, and yellow dye images, all as known in the art. The coupler may be introduced into the film during processing but is preferably present in the film before exposure and processing. The coupler may be monomeric or polymeric in nature. The magenta dye-forming couplers useful in the color photographic originating materials, and particularly in the color negative films of this invention, include the optionally substituted: 3-amidopyrazoles; the pyrazolotriazoles and particularly the pyrazolotriazole couplers disclosed in U.S. Pat. No. 5,254,446, incorporated by reference; and the 3-amino-pyrazoles. The cyan dye-forming image couplers useful in the color photographic originating materials, and particularly in the color negative films of this invention, include the optionally substituted: phenols; 2-substituted-1-naphthols; 2,5-disubstituted-1-naphthols; and 2-(disubstituted carboxyanalide)-1-naphthols. The useful yellow dye forming couplers include the acetanalide and benzoylacetanalide couplers. While these dye image-forming couplers may have any equivalency known in the art is specifically contemplated that they be four equivalent couplers or preferably two equivalent couplers. The terms "equivalent" and "equivalency" indicate the formal stoichiometric relationship between the number of moles of silver reduced per mole of image dye formed in a coupling reaction. The color negative film may then be optionally desilvered using any technique known in the art. The image thus formed is borne on a support that is sufficiently transparent to enable the susequent color printing step known in the art.

The components, assembly, and processing of color negative films are described in detail at *Research Disclosure* Item 36544, 1994 and *Research Disclosure* Item 37038, 1995, both published by Kenneth Mason Publications, Ltd., The Old Harbormaster's 8 North Street, Emsworth, Hampshire P010 7DD, England, the disclosures of which are incorporated by reference. Materials and methods useful in the preparation of color negative films are additionally described at T. H. James, Ed., "The Theory of the Photographic Process," Macmillan, New York, 1977; "The Kirk-Othmer Encyclopedia of Chemical Technology," John Wiley and Sons, New York, 1993; Neblette's "Imaging Processes and Materials," Van Nostrand Reinhold, New York, 1988; and Keller, Ed. "Science and Technology of Photography," VCH, New York, 1993. Typical color negative films illustrating art recognized practice in the layer order, formulation, manufacture and in the selection and use of components for such photographic elements include, but are by no means limited by, Gold Plus 100, Gold Ultra 400, Ektar 25, Ektar 1000, Vericolor III, Eastman High Speed Motion Picture Film, all manufactured and sold by Eastman Kodak Company, and SH-100, SH-400, and SH-800 color negative films, all manufactured and sold by Fuji Photo Film. The advantages of current invention may be achieved by modifying any of these formulations to the extent necessary to conform to the requirements set forth in the specification. The exact magnitude of the benefits achieved will, of course, depend on the exact details of the formulations involved, but these will be readily apparent to the skilled practitioner.

Photographic elements useful in this invention can additionally include compounds capable of releasing photographically useful moieties, including but not limited to development inhibitor releasing (DIR) compounds, development accelerator releasing compounds, bleach accelerator releasing compounds, dye releasing compounds, scavengers, color masking compounds and such, all as known in the art and as exemplified in the art practice and references cited above and below. Also useful are both spatially fixed and solubilized pre-formed dyes which can be employed to control sensitivity, halation, light scatter, spectral response and as color printing and color balancing aids. The moieties thus released can be either ballasted, in which case they remain localized at or near the point of release, they may be unballasted, in which case they diffuse from the element during processing, or they may be intermediately ballasted, in which case they may partially diffuse through the element during processing.

In a preferred mode, the elements include DIR compounds. While any DIR compound can be employed in the practice of this invention, the DIR compounds which enable release of development inhibitor moieties lacking a free sulfur valence that can bind to silver are preferred, since they enable improved desilvering of such films. In other words, it is preferred that the elements of this invention be substantially free of certain development inhibitors having a free valence that binds to silver. Such development inhibitors typically comprise a silver halide binding group having a sulfur, selenium or tellurium with a free valence that can form a bond wiht silver atoms, as well as a ballast moiety. The presence of such compounds appears to slow down the rate of desilvering (that is, bleaching or bleach-fixing) in the elements described herein, as compared to other classes of development inhibitors or where development inhibitors re completely absent. By "substantially free" is meant that the element at bleaching contains no more than about 0.003 mol of such development inhibitors per mol of silver and silver halide. In a preferred embodiment, the quantity of such development inhibitors is less than about 0.001 mol per mole of coated silver and silver halide. These relative quantities are best assured by controlling both the quantity of development inhibitor releasing (DIR) compounds and unblocked development inhibitors having the undesired characteristics, as well as the quantity of silver halide during the preparation of the light sensitive element. In other words, before photographic development, the element should contain less than 0.003 mol total of both DIR compounds capable of releasing a development inhibitor having a free sulfur, selenium or tellurium valence that binds to silver and such development inhibitors themselves in unblocked form, per mol of silver halide. In a more preferred embodiment, this ratio should be less than about 0.001 mole pre mole of silver halide. In such amounts, the development inhibitors do not significantly retard silver bleaching. In the practice of this invention, it is preferred to use development inhibitors having a heterocyclic nitrogen as a silver binding group, such as oxazoles, thiazoles, diazoles, triazoles, oxadiazoles, thiadiazoles, oxadiazoles, thitriazoles, benzotriazoles, tetrazoles, benzamidizoles, indazoles, isoindazoles, benzodiazoles or benzisodiazoles. The released development inhibitors can be stable in a processing solution, or they can change in function and effect as a result of chemical reaction with components of the processing solutions.

The release compounds described above are preferably couplers and enable imagewise release of the photographically useful moieties. When these release compounds are couplers, they can form permanent dye deposits which substantially contribute to the image, or they can form, low extinction, fugitive or wash-out dyes, i.e., they can be the so-called universal couplers. When the compounds are dye forming couplers, they can be in color complementary association to the spectral sensitivity of the light sensitive emulsions, i.e., as a cyan dye forming coupler with a red light sensitive emulsion or can be employed in mixed mode, for example, as a yellow dye forming coupler with a green light sensitive emulsion. They can be coated in the same layer as the light sensitive silver halide emulsions or in the auxiliary layers, so long as they are in reactive association with the light sensitive emulsions. The compounds can directly release the photographically useful moieties or may release the photographically useful moeities in blocked form that, in turn, enables release of the moieties either by first order decay, as for example, by electron-transfer down an optionally conjugated chain or by anchiameric release, or by reaction with other components present during a processing step. The release mechanisms can be used singly or in tandem as known in the art. It is intended that these compounds be employed in reactive association with one another and with the image couplers all as known in the art. In a most preferred mode, the element will comprise both a DIR compound and a bleach accelerator releasing compound. When both are present, proper tones scale reproduction and excellent desilvering are acheived.

In assembling the light sensitive element of the invention, it is generally preferred to minimize the thickness of the element above the support so as to improve sharpness and improve access of processing solutions to the components of the element. For this reason, dry thicknesses of less than 30 micrometers are generally useful while thicknesses of between about 3 and 25 micrometers are preferred, and thicknesses of between about 7 and 20 micrometers are even more preferred. These lowered thicknesses can be enabled at manufacture by use of surfactants and coatings aids as known in the art so as to control viscosity and shear. Both sharpness and ease of processing may be further improved by minimizing the quantity of incorporated silver in the element. While any useful quantity of light sensitive silver may be employed in the elements of this invention, total silver quantities of between about 1 and 10 grams per square meter are contemplated, and total silver of less than about 7 grams per square meter are preferred. Total silver of between about 1 and about 5 grams per square meter are even more preferred. Within the element, emulsions (A) and (B) can be in the same layer or in different layers. When emulsions (A) and (B) are in different layers, these layers can be disposed relative to the support in any arrangement known in the art. Particularly, when emulsions (A) and (B) are in different layers on the same side of the support, either emulsion can be positioned closer to the support than the other. The emulsions can be sensitized to different regions of the electromagnetic spectrum or preferentially to the same region of the electromagnetic spectrum. Emulsion (A) and emulsion (B) may have the same light sensitivity or may differ in sensitivity. Although any relative proportions of emulsions (A) and (B) may be employed, the ratio of emulsion (A) to emulsion (B) will generally be between 95:5 and 5:95. This ratio will preferably be between 85:15 and 15:85, and most preferably be between 75:25 and 25:75. The elements to be employed in this invention can comprise, in addition to emulsions (A) and (B), other AgCl, AgBr, AgClBr, AgCII, AgClBrI and AgBrI emulsions of morphologies and halide content and distribution as known in the art. It is generally preferred that emulsion (A) and (B) together comprise at least 50 mole percent of the total silver halide in the elements of this invention, and in a more preferred mode at least 70 mole percent of the total silver halide, and in a most preferred mode, at least 90 mole percent of the total silver halide of the element. It is preferred that the overall halide content and distribution of the element be controlled so as to ensure both rapid development and ease of subsequent desilvering. In this context, the element should comprise at least 30 mole percent chloride based on total silver, and preferentially comprise at least 50 mole percent chloride. It is more preferred that the element comprise at least 70 mole percent chloride, and most preferred that it comprise at least 90 mole percent chloride. Overall iodide content should be less than about 10 mole percent iodide based on total included silver, more preferably less than about 5 mole percent iodide, and most preferably less than about 3 mole percent iodide. The remainder of the halide can be bromide. Sharpness and color rendition in color images is further improved by complete removal of silver and silver halide from the element on processing. Since more swellable elements enable better access of components of processing solutions to the elements of this invention, swell ratios above 1.25 are preferred, with swell ratios of between 1.4 and 6 being more preferred and swell ratios of between 1.7 and 3 being most preferred. Use of development, bleach, fix and bleach-fix accelerators as known in the art and earlier described is additionally useful to in this context. The balance of total thickness, total silver, total halide distribution and swell ratio most suitable for an element intended for a specific purpose being readily derived from the image structure, color reproduction, sensitivity, physical integrity and photographic resistance to pressure required for that purpose as known in the art. These elements can be hardened as known in the art.

The supports employed in this invention are flexible supports. While any suitable support may be employed for the color originating materials, and specifically the color negative films useful in the practice of the invention, it is specifically contemplated to employ supports bearing magnetic information layers as described at *Research Disclosure* Item 34390, 1992 and at U.S. Pat. Nos. 5,252,441 and 5,254,449, the disclosures of which are incorporated by reference. Typical flexible supports include films of cellulose nitrate, cellulose acetate, polyvinylacetal, polyethylene terephthalate, polycarbonate and related resinous and polymeric materials. These supports can be of any suitable thickness and will preferably be less than about 150 micrometers thick, more preferably between about 50 and 130 micrometers thick, and most preferably between about 60 and 110 micrometers thick.

The term photographic image display material includes any light sensitive photographic material suitable for direct viewing by reflected light, such as a color photographic paper; direct viewing by transmitted light, such as a color photographic advertising transparency; or suitable for projected viewing, such as a color photographic motion picture print film. Also included are those related materials typically employed as intermediate films suitable for preparing multiple copies of a display material.

Most generally, these photographic display materials will comprise a red light sensitive color record capable of forming a cyan dye deposit, a green light sensitive color record capable of forming a magenta dye deposit, and a blue light sensitive color record capable of forming a yellow dye deposit. The red light color record will typically have a peak sensitivity at between about 690 and 710 nm, and the green light color record will typically have a peak sensitivity at about 545 and 555 nm. The peak sensitivity of the blue light color record useful in the practice of the current invention will be between 450 and 490 nm. The chromogenic dye deposits will typically be formed during a development step which comprises contacting the display material with a basic solution and a paraphylene diamine development agent to reduce silver halide to silver metal with concomitant production of an oxidized form of color developer. This oxidized color developer in turn reacts with a photographic coupler to form the chromogenic cyan, magenta, and yellow dye images, all as known in the art. The coupler may be introduced into the material during processing but is preferably present in the material before exposure and processing. The couplers may be monomeric or polymeric in nature. The magenta dye-forming couplers useful in the display material include the optionally substituted: 3-amidopyrazoles; the pyrazolotriazoles and particularly the pyrazolotriazole couplers disclosed in U.S. Pat. No. 5,254,446, incorporated by reference; and the 3-aminopyrazoles. The cyan dye-forming image couplers useful in the display materials invention include the optionally substituted: phenols; 2-substituted-1-naphthols; 2,5-disubstituted-1-naphthols; and 2-(disubstituted carboxyanalide)-1-naphthols. The useful yellow dye forming couplers include the acetanalide and benzoylacetanalide couplers. While these dye image-forming couplers may have any equivalency known in the art, it is specifically contemplated that they be four equivalent couplers or preferably two equivalent couplers. The development step may be amplified by the presence of peroxides as known in the art. The display material may then be optionally desilvered using any technique known in the art. The display image may be borne on a reflective support, such as that used in color papers or on a transparent support such as that used in motion picture projection films.

The components, assembly, and processing of color photographic display materials are described in detail at *Research Disclosure* Item 36544, 1994; and Item 37038, 1995, both published by Kenneth Mason Publications, Ltd., The Old Harbormaster's 8 North Street, Emsworth, Hampshire P010 7DD, England, the disclosures of which are incorporated by reference. Materials and methods useful in the preparation of color photographic display materials are additionally described at T. H. James, Ed., "The Theory of the Photographic Process," Macmillan, New York, 1977; "The Kirk-Othmer Encyclopedia of Chemical Technology," John Wiley and Sons, New York, 1993; Neblette's "Imaging Processes and Materials," Van Nostrand Reinhold, New York, 1988; and Keller, Ed. "Science and Technology of Photography", VCH, New York, 1993. Materials useful in the preparation of color papers are further illustrated by current commercial practice as, for example, by EDGE, PORTRA or SUPRA Color Papers as sold by Eastman Kodak Company, by FUJI FA-family Color Papers as sold by Fuji Photo Film, by KONICA QA-family Color Papers as sold by Konishiroku Industries, by EASTMAN COLOR PRINT motion picture projection film as sold by Eastman Kodak Company, by AGFA MP-family motion picture prim films as sold by Agfa-Gevaert, by DURATRANS and DURACLEAR display films as sold by Eastman Kodak Company, and by KONSENSUS-II display films as sold by Konishiroku Industries. The advantages of current invention may be achieved by modifying any of these formulations to conform to the requirements set forth in the specification. The exact magnitude of the benefits achieved will, of course, depend on the exact details of the formulations involved, but these will be readily apparent to the skilled practitioner. Most generally, display elements will contain between about 0.05 and 3 grams of silver per square meter of support and preferentially between about 0.2 and 1 gram of silver per square meter for a typical color paper. The photoactive layers of display elements will generally be thinner than those of the camera films described earlier, while other characteristics, such as total halide distribution and swell ratio, will be similar to that described for the camera speed films.

Whether the light sensitive elements of this invention are color originating or color display materials, it is generally intended that they be supplied on spools or in cartridge form generally as known in the art. When the element is supplied in spool form, it may be wrapped about a core and enclosed in a removable housing with an exposed film leader as known in the art. When the element is supplied in cartridge form, the cartridge may enclose a light sensitive photographic element in roll form and a housing surrounding the film to form a cartridge receptacle for protecting the film from exposure and an opening for withdrawing the film from the cartridge receptacle. It is further intended that such materials be supplied in a length which results in the element being forced to assume a radius of curvature of less than about 12,000 micrometers, and preferably a radius of curvature less than about 9,000 or 6,500 or even 6,000 micrometers or even less.

In another embodiment, the element may be supplied on similar or even less demanding spools and forced by a camera mechanism or the like through a constricted radius of curvature as small as 1,400 or even 1,000 microns. This severe curvature may occur in a consumer loadable camera or in a preloaded camera as known in the art. These cameras can provide specific features as known in the art such as shutter means, film advance means, waterproof housings, single or multilple lenses, lens selection means, variable aperture, focus or focal length lenses, means for monitoring lighting conditions, means for altering shutter times or lens characteristics based on lighting conditions or user provided instructions, and means for recording use conditions directly on the film. When the element is supplied in a preloaded camera, known also as a film with camera unit or a single use or recyclable camera, the camera may comprise a lens, a shutter, the element in roll form, means for holding the element in roll form prior to exposure, means for mounting a portion of the element for exposure through the lens, means for receiving portions of the element from the mounting means, and a housing for mounting the lens and shutter and for restricting light access to the film to that entering the camera through the lens. Photographic Elements according to the current invention are particularly useful in Limited Use Cameras as described in allowed, commonly assigned U.S. patent application Ser. No. 135,700 filed 13 Oct. 1993, the disclosures of which are incorporated by reference.

Generally, the elements of the invention may be processed in any manner known in the photographic arts, as has already been set forth.

Processing generally includes a development step to reduce the imagewise exposed silver halide to metallic silver with concomitant oxidation of a color developing agent all as described in detail earlier. Any color developing agent that is suitable for use with low iodide, chloride containing elements may be used with this invention. These include aminophenols and paraphenylenediamines. While the concentration of developing agent to be employed in the practice of this invention can be any concentration known in the art, it is preferred that the concentration be between about 0.5 and 200 mmol/L, with a concentration range between about 2 and 80 mmol/L being preferred, a range between about 5 and 65 mmol/L being more preferred, and a concentration range between about 10 and 60 mmol/L being most preferred. While the paraphenylene diamine developing agent is typically added to the developing solution directly, it may also be provided by incorporation in a blocked form directly in the light sensitive color element as described in U.S. Pat. No. 5,256,525. Alternatively, the blocked form of the developer may be employed in a replenisher element as described in U.S. Pat. No. 5,302,498. The structures of other useful paraphenylene diamine color developers may be found at U.S. Pat. Nos. 5,063,144 and 5,176,987.

Examples of aminophenol developing agents include o-aminophenol, p-aminopehnol, 5-amino-2-hydroxytoluene, 2-amino-3-hydroxytoluene, and 2-hydroxy-3-amino-1,4-dimethylbenzene. Particularly useful primary aromatic amino developing agents are the p-phenylenedia-mines and especially the N,N-dialkyl-p-phenylenediamines in which the alkyl groups or the aromatic nucleus can be substituted or unsubstituted. Examples of useful p-phenylenediamine developing agents include: N,N-diethyl-p-phenylenediamine monohydrochloride, 4-N, N-diethyl-2-methylphenylyenediamine monohydrochloride, 4-(N-ethyl-N-2-methanesulfonylaminoethyl)-2-methylphenylenediamine sesquisulfate monohydrate, 4-(N-ethyl-N-2-hydroxyethyl)-2-methylphenylenediamine sulfate, and 4-N,N-diethyl-2,2'-methanesulfonylaminoethylphenylenediamine hydrochloride.

In addition to the primary aromatic amino color developing agent, the color developing solution may contain a variety of other agents such as alkalies to control pH, bromides, chlorides, iodides, benzyl alcohol, anti-oxidants, anti-foggants, solubilizing agents, brightening agents and so forth.

The photographic color developing composition may be employed in the form of aqueous alkaline working solutions having a pH of above 7 and preferably in the range of from about 9 to about 13. The developer solution is preferably maintained at a pH between about 9 and 12 and most preferably maintained at a pH of about 9.5 and 11.5. To provide the necessary pH, they may contain one or more of the well-known and widely used pH buffering agents, such as the alkali metal carbonates or phosphates. Potassium carbonate is especially preferred.

The contact time of the photographic element with the developer solution is between about 5 and 150 seconds. Preferably, the contact time is between about 10 and 120 seconds, and most preferably the contact time is less than about 95 seconds. Shorter contact times tend to not allow for sufficient and even penetration of the developer solution into a photographic element, while longer contact times result in poor sharpness, thereby clearly defeating the intent of the current invention. Additionally, the shorter contact times enable improved image formation in multilayer, multicolor film elements by surprisingly enabling a greater homogeneity in extent of development between the imaging layers situated at different depths in the element.

The temperature of the development solution is typically regulated using means well known in the art at between about 25° C. and 65° C. Preferably, the temperature is maintained at between about 30° C. and 55° C. and most preferably the temperature is maintained at between about 35° and 45° C. Lower temperatures lead to excessively long development times, thus defeating the purpose of the invention, while higher temperatures lead to excessive fog growth and loss of image to fog discrimination which may alternatively be described as inferior signal-to-noise characteristics in the formed image.

The developer solution useful in the practice of this invention comprises bromide ion which can be provided as any of the known bromide salts including but not limited to potassium bromide, sodium bromide, lithium bromide, and ammonium bromide. While bromide in trace amounts may be employed in the developer, the bromide ion concentration is generally maintained at a level greater than about 0.18 mmol/L. Improved layer to layer development homogeneity is more easily attained at higher bromide ion concentrations. While bromide ion concentration between about 0.25 and 50 mmol/L may be employed for this purpose, a bromide ion concentration between about 1 and 28 mmol/L is preferred, and a bromide ion concentration between about 3 mmol/L and 25 mmol/L is even more preferred. Lower levels of bromide can lead to an unsatisfactory imbalance in the extent of development of overlying and underlying layers in a multilayer, multicolor photographic element, while higher levels of bromide can cause unwanted restraint of development. The higher levels of developer solution bromide ion useful in the practice of this invention are enabled by the surprisingly low extent of bromide for chloride ion metathesis encountered when developing the the high chloride tabular grain emulsions required for the practice of this invention in the developer solutions of this invention.

It may additionally be useful to control the balance of developing agent and bromide ion in the practice of this invention. Most generally, the ratio of the concentration of developing agent to bromide ion should be between about 60:1 and 1:2. It is preferable that the ratio of developing agent to bromide ion concentration be between about 50:1 and 4:5 and more preferable that this ratio be between about 40:1 and 9:10. It is most prefered that the ratio of developing agent concentration to bromide ion concentration in the developing solution be between about 30:1 and 1:1.

These, and all other characteristics of process solutions and concentrations of components in process solutions mentioned throughout, should be determined just before the light sensitive element comes into contact with the process solution. The contact time of an element with a process solution is the time elapsed from when the element first contacts the process solution to when the element is withdrawn from contact with the same process solution.

The developer solutions useful in the practice of this invention may additionally contain chloride ion. Chloride ion concentrations of between about 0 and 300 mmol/L are useful, with chloride ion concentrations between about 0 and 100 mmol/L being preferred. On extended use of the developer solution to develop high chloride emulsions, chloride levels of between about 15 and 80 mmol/L may be typically encountered. Additionally, the developer solutions useful in the practice of this invention may include iodide ion as known in the art. Trace quantities of iodide ion at concentrations between about 0 and 0.1 mmol/L are contemplated with iodide concentrations less than about 0.01 mmol/L being preferred.

Antioxidants such as hydroxylamine, dialkyl hydroxylamines, alkanolamines, hydrazincs, and aminocarboxylic acids are additionally useful in the developer solutions of this invention at any concentration known in the art. While hydroxylamine is believed to behave as a mild developer for silver chloride emulsions, the halide ion incorporated in the developer solutions useful in the practice of this invention may generally be adequate to ameliorate such activity. The dialkyl hydroxylamines, alkanolamines, and aminocarboxylic acids can be employed when such activity is objectionable. Useful dialkyl hydroxylamines, alkanolamines, hydrazincs, and aminocarboxylic acids are well known in the art and include diethyl hydroxylamine, ethanolamine, and glycine, as well as those illustrated in U.S. Pat. Nos. 4,892,804, 5,071,734, 4,978,786, 4,800,153, 4,801,516, 4,814,260, 4,965,176, and 4,966,834, the disclosures of which are incorporated by reference. The total quantity of amine antioxidants is preferably between about 0.5 and 10 moles of antioxidant per mole of paraphenylene diamine developing agent. Inorganic anitoxidants as known in the art, such as sulfite ion, bisulfite ion, and the like are also useful. Typically these inorganic antioxidants are employed at art known useful concentrations. For example, less than about 50 mmol/L of sulfite or sulfite equivalent is generally found to be useful, with concentrations of less than about 16 mmol/L being preferred. It may additionally be useful to incorporate sequestering agents for iron, calcium, and the like, examples being aromatic polyhydroxy compounds, aminopolyphosphonic acids, and aminopolycarboxylic acids. Additional compounds to improve clarity of the developer solution such as sulfonated polystyrenes, as well as antistaining agents and wetting agents, all as disclosed in U.S. Pat. No. 4,892,804 are also recommended. The use of art known color developing agent solubilizing agents, as exemplified by p-toluenesulfonic acid, is also preferred.

A typical developer solution useful in the practice of this invention may be formulated from 800 mL of water, 34.3 g of anyhdrous potassium carbonate, 2.32 g of potassium bicarbonate, 0.38 g of anhydrous sodium sulfite, 2.96 g of sodium metabisulfite, 1.2 mg of potassium iodide, 1.31 g of sodium bromide, 8.43 g of diethylenetriaminepentaacetic acid pentasodium salt supplied as a 40% solution, 2.41 g of hydroxylamine sulfate, 4.52 g of N-(4-amino-3-methylpheny1)-N-ethyl-2-aminoethanol) as its sulfuric acid salt, and sufficient additional water and acid or base to make 1L of solution at a pH of 10.00+/−0.05 at 26.7° C.

Another typical developer useful in the practice of this invention may be formulated from 800 mL of water, 11 mL of 100% triethanolamine, 0.25 mL of 30% lithium polystyrene sulfonate, 0.24 g of anhydrous potassium sulfite, 2.3 g of Blankophor REU, 2.7 g of lithium sulfate, 0.8 mL of 60% 1-hydroxyethyl-l,1-diphosphonic acid, 1.8 g of potassium chloride, 0.3 g of potassium bromide, 25 g of potassium carbonate, 6 mL of 85% N,N-diethylhydroxylamine, 4.85 g of N-(4-amino-3-methhylphenyl)-N-ethyl-2-aminoethylmethanesulfonamide as its sesquisulfuric acid monohydrate salt, and sufficient additional water and acid or base to make 1L of solution at a pH of 10.12+/−0.05 at 25° C.

Yet another typical developer useful in the practice of this invention may be formulated from 800 mL of water, 5.5 mL of 100% triethtanolamine, 0.25 mL of 30% lithium polystyrene sulfonate, 0.5 mL of 45% potassium sulfite, 1 g of Blankophor REU, 2 g of lithium sulfate, 0.6 mL of 60% 1-hydroxyethyl-l,1-diphosphonic acid, 0.6 mL of 40% diethylenetriaminepentaacetic acid pentasodium salt, 6 g of potassium chloride, 0.8 g of potassium bromide, 25 g of potassium carbonate, 3 mL of 85% N,N-diethylhydroxylamine, 3.8 g of N-(4-amino-3-methylphenyl)-N-ethyl-2-aminoethyl-methanesulfonamide as its sesquisulfuric acid monohydrate salt, and sufficient additional water and acid or base to make 1L of solution at a pH of 10.10+/−0.05 at 25° C.

Another useful developer may be formulated from 800 mL of water, 1 mL of 40% aminotris(methylenephosphonic acid) pentasodium salt, 4.35 g of anhydrous sodium sulfite, 1.72 g of anhydrous sodium bromide, 17.1 g of sodium carbonate monohydrate, 2.95 g of 4-N,N-diethyl-2-methylphenylenediamine as its hydrochloric acid salt, and sufficient additional water and acid or base to make 1L of solution at a pH of 10.53+/−0.05 at 26.7° C.

An additional useful developer may be formulated from 600 mL of water, 2 mL of 40% aminotris (methylenephosphonic acid) pentasodium salt, 2 g of anhydrous sodium sulfite, 1.2 g of anhydrous sodium bromide, 30 g of sodium carbonate monohydrate, 0.22 g of 3,5-dinitrobenzoic acid, 4 g of N-(4-amino-3-methyl-phenyl)-N-ethyl-2-aminoethyl-methanesulfonamide as its sesquisulfuric acid monohydrate salt, 0.17 mL of sulfuric acid, and sufficient additional water and acid or base to make 1L of solution at a pH of 10.20+/−0.05 at 26.7° C.

The development step may be followed by an optional treatment with an acidic stop bath, by one or more bleaching steps which serve to oxidize silver metal to either solubilized silver ion or to silver halide depending on the details of the bleaching solution formulation, by one or more fixing steps where a fixer solution solubilizes and removes silver halide from the element, by one or more washing steps, by stabilizing steps, and by a drying step. The bleaching step and the fixing step may be combined in a bleach-fixing step. Preferred methods of processing high chloride tabular grain light sensitive elements according to the invention are set forth in commonly assigned U.S. patent application Ser. No. 08/035,347 filed 22 Mar. 1993, now allowed and in U.S. patent application Ser. No. 08/380,544 filed 30 Jan. 1995, the disclosures of which are incorporated by reference.

PREPARATIVE PHOTOGRAPHIC ELEMENT EXAMPLE 1

This example illustrates the preparation of a control multilayer multicolor color photographic element.

A color photographic recording material (Control Photographic Sample 1) for color development was prepared by applying the following layers in the given sequence to a transparent support of cellulose triacetate. The quantities of silver halide are given in g of silver per $m^2$. The quantities of other materials are given in g per $m^2$.

Layer 1 {Antihalation Layer}: DYE-1 at 0.005 g; DYE-2 at 0.011 g; C-39 at 0.129 g; DYE-6 at0.161 g; DYE-9 at 0.075g; SOL-1 at0.011 g; SOL-2 at 0.011 g; with 2.1 g gelatin.

Layer 2 {Lowest Sensitivity Red-Sensitive Layer}: Red sensitive silver chloride {111}-faced iodide banded tabular grain emulsion, average equivalent circular diameter 0.6 microns, average thickness 0.1 microns (99.4 mol percent chloride, 0.6 mol percent iodide) at 0.140 g; C-8 at 0.66 g; D-1 at 0.016g; D-32 at 0.004; C42 at 0.065 g; ST-16 at 0.01 g; B-1 at 0.043 g; with gelatin at 1.29 g.

Layer 3 {Medium Sensitivity Red-Sensitive Layer}: Red sensitive silver chloride {111}-faced iodide banded tabular grain emulsion, average equivalent circular diameter 1.0 microns, average grain thickness 0.1 microns (99.4 mol percent chloride, 0.6 mol percent iodide) at 0.33 g; C-8 at 0.17 g; D-1 at 0.003 g; C-42 at 0.032 g; C-41 at 0.022 g; ST-16 at 0.01 g; with gelatin at 0.59 g.

Layer 4 {Highest Sensitivity Red-Sensitive Layer}: Red sensitive silver chloride {111}-faced iodide banded tabular grain emulsion, average equivalent circular diameter 1.4 microns, average grain thickness 0.12 microns (99.4 mol percent chloride, 0.6 mol percent iodide) at 0.70 g; C-8 at 0.052 g; D-1 at 0.002 g; D-32 at 0.001 g; C-42 at 0.022 g; C-41 at 0.011 g; ST-16 at 0.01 g; with gelatin at 1.18 g.

Layer 5 {Interlayer}: ST-4 at 0.11 g with 0.75 g of gelatin.

Layer 6 {Lowest Sensitivity Green-Sensitive Layer}: Green sensitive silver chloride {111}-faced iodide banded tabular grain emulsion, average equivalent circular diameter 1.0 microns, average grain thickness 0.07 microns (99.4 mol percent chloride, 0.6 mol percent iodide) at 0.16 g; C-2 at 0.28 g; D-1 at 0.022 g; I-18 at 0.003 g; C-40 at 0.065 g; ST-5 at 0.20 g; ST-16 at 0.01 g; with gelatin at 0.95 g.

Layer 7 {Medium Sensitivity Green-Sensitive Layer}: Green sensitive silver chloride {111}-faced iodide banded tabular grain emulsion, average equivalent circular diameter 1.4 microns, average grain thickness 0.12 microns (99.4 mol percent chloride, 0.6 mol percent iodide) at 0.32 g; C-2 at 0.043 g; D-1 at 0.006 g; I-18 at 0.011 g; C-40 at 0.022 g; ST-5 at 0.011 g; ST-16 at 0.01 g; with gelatin at 0.59 g.

Layer 8 {Highest Sensitivity Green-Sensitive Layer}: Green sensitive silver chloride {111}-faced iodide banded tabular grain emulsion, average equivalent circular diameter 2.3 microns, average grain thickness 0.8 microns (99.4 mol percent chloride, 0.6 mol percent iodide) at 0.70 g; C-2 at 0.065 g; C-40 at 0.022 g; D-1 at 0.001 g; ST-16 at 0.01 g; with gelatin at 1.18 g.

Layer9 {Interlayer}: ST-4at0.11 g with 0.75 g of gelatin.

Layer 10 {Lowest Sensitivity Blue-Sensitive Layer}: Blue sensitive silver chloride {111}-faced iodide banded tabular grain emulsion with average equivalent circular diameter of 0.6 microns and average grain thickness of 0.1 microns (99.4 mol percent chloride, 0.6 mol percent iodide) at 0.15 g; and a blue sensitive silver chloride {111}-faced iodide banded tabular grain emulsion with average equivalent circular diameter of 1.1 microns and average grain thickness of 0.08 microns (99.4 mol percent chloride, 0.6 mol percent iodide) at 0.14 g; C-27 at 0.21 g; C-29 at 0.7 g; I-18 at 0.001 g; D-7 at 0.004 g; ST-16 at 0.01 g; with gelatin at 1.5 g.

Layer 11 {Highest Sensitivity Blue-Sensitive Layer}: Blue sensitive silver chloride {111}-faced banded iodide tabular grain emulsion with average equivalent circular diameter of 2.3 microns and average grain thickness of 0.08 microns (99.4 mol percent chloride, 0.6 mol percent iodide) at 0.86 g; C-27 at 0.043g; C-29 at 0.13 g; I-18 at 0.001 g; D-7 at 0.007 g; ST-16 at 0.01 g; with gelatin at 1.29 g.

Layer 12 {Protective Layer-1}: DYE-8 at 0.1 g; DYE-9 at 0.1 g; and gelatin at 0.7 g.

Layer 13 {Protective Layer-2}: silicone lubricant at 0.04 g; tetraethylammonium perfluoro-octane sulfonate; anti-matte polymethylmethacrylate beads at 0.11 g; soluble anti-matte polymethacrylate beads at 0.005 g; and gelatin at 0.89 g.

This film was hardened at coating with 2% by weight to total gelatin of hardner. The organic compounds were used as emulsions containing coupler solvents, surfactants and stabilizers, or used as solutions both as commonly practiced in the art. The coupler solvents employed in this photographic sample included: trieresylphosphate; di-n-butyl phthalate; di-N-butyl sebacate; N,N-di-n-ethyl lauramide; N,N-di-n-butyl laurarnide; 2,4-di-t-amylphenol; N-butyl-N-phenyl acetamide; and 1,4-cyclohexylenedimethylene bis-(2-ethoxyhexanoate). Mixtures of compounds were employed as individual dispersions or as co-dispersions as commonly practiced in the art. The sample additionally comprised sodium hexametaphosphate, 1,3-butanediol, 4-hydroxy-6-methyl-1,3,3*a*,7-tetraazaindene and disodium-3,5-disulfocatechol. The silver halide emulsions employed in this sample all comprised a silver chloride core with a surrounding iodide band, and comprised about 0.6 mol % bulk iodide. These were prepared following the procedures described in U.S. Pat. Nos. 5,035,992; 5,217,858; and 5,389,509, all incorporated by reference, followed by a washing step to remove the organic stabilizer compound. Other surfactants, coating aids, scavengers, soluble absorber dyes and stabilizers, as well as various iron, lead, gold, platinum, palladium, iridium, and rhodium salts salts were optionally added to the various emulsions and layers of this sample as is commonly practiced in the art so as to provide good preservability, processability, pressure resistance, anti-fungal and antibacterial properties, antistatic properties, and coatability. The total dry thickness of all the applied layers above the support was about 19 micrometers, while the thickness from the innermost face of the sensitized layer closest to the support to the outermost face of the sensitized layer furthest from the support was about 15 micrometers.

DYE-1, DYE-2, DYE-6, DYE-8, DYE-9, Coupler C-1, Coupler C-8, Coupler C-27, Coupler C-29, Dye Releaser C-39, Dye Releaser C-40, Dye Releaser C-41, Dye Releaser C-42, Bleach Accelerator B-1, DIR compound D-1, DIR compound D-7, DIR compound D-32, soluble dye SOL-1 and soluble dye SOL-2 are from U.S. Pat. No. 5,292,632, incorporated by reference, and carry the identical identifier therein. DIR compound I-18 is I-18 of U.S. Pat. No. 5,250,399 incorporated by reference. Stabilizers ST-4, ST-5, and ST-16 are from *Research Disclosure* publication 37038, 1995 pages 79–115, incorporated by reference.

Inventive Photographic Sample 2 was prepared like control Photographic Sample 1 except that the {111}-faced banded iodide tabular grain high chloride emulsions employed in layers 4, 8, and 11 were replaced by similarly sensitized {100}-faced banded iodide tabular grain high chloride emulsions having similar halide content and distribution and similar grain size characteristics prepared according to Brust et al as described in U.S. Pat. No. 5,314,798, incorporated by reference.

Inventive Photographic Sample 3 was prepared like inventive Photographic Sample 2 except that the {111}-faced banded iodide tabular grain high chloride emulsions employed in layers 3, 7 were replaced by similarly sensitized {100}-faced banded iodide tabular grain high chloride emulsions having similar halide content and distribution and similar grain size characteristics prepared generally according to Example Emulsion D of Brust et al as described in U.S. Pat. No. 5,314,798, incorporated by reference.

Control photographic Sample 4 was prepared like inventive Photographic Sample 3 except that the {111}-faced banded iodide tabular grain high chloride emulsions employed in layers 2, 6, and 10 were replaced by similarly sensitized {100}-faced banded iodide tabular grain high chloride emulsions having similar halide content and distribution and similar grain size characteristics prepared generally according to Example Emulsion D of Brust et al as described in U.S. Pat. No. 5,314,798, incorporated by reference.

COMPARATIVE DEVELOPMENT PROCESS EXAMPLE 2

This example describes a color negative processing of the photographic samples and illustrates that the samples a) all had sufficient light sensitivity to be employed as camera speed elements, and b) all were adequately desilvered.

Portions of Photographic Samples 1–4 were exposed to light through a graduated density test object and developed according to the following process:

| | | | |
|---|---|---|---|
| Develop | 90" | Developer-I | 38° C. |
| Bleach | 240" | Bleach-I | 38° C. |
| Wash | 180" | Water | ca 35° C. |
| Fix | 240" | Fix-I | 38° C. |
| Wash | 180" | Water | ca 35° C. |
| Rinse | 60" | Rinse | ca 35° C. |

Developer-I was formulated by adding water, 34.3 g of potassium carbonate, 2.32 g of potassium bicarbonate, 0.38 g of anhydrous sodium sulfite, 2.96 g of sodium metabisulfite, 1.2 g of potassium iodide, 1.31 g of sodium bromide, 8.43 g of a 40% solution of diethylenetriaminepentaacetic acid pentasodium salt, 2.41 g of hydroxylamine sulfate, 4.52 g of (N-(4-amino-3-methylphenyl)-N-ethyl-2-aminoethanol) as it's sulfuric acid salt and sufficient additional water and sulfuric acid or potassium hydroxide to make 1L of solution at a pH of 10.00+/-0.05 at 26.7° C.

Bleach-I was formulated by adding water, 37.4 g of 1,3-propylenediamine tetraacetic acid, 70 g of a 57% ammonium hydroxide solution, 80 g of acetic acid, 0.8 g of 2-hydroxy-1,3-propylenediamine tetraacetic acid, 25 g of ammonium bromide, 44.85 g of ferric nitrate nonahydrate and sufficient water and acid or base to make 1L of solution at a pH of 4.75.

Fix-I was formulated by adding water, 214 g of a 58% solution of ammonium thiosulfate, 1.29 g of (ethylenedinitrilo)tetraacetic acid disodium salt dihydrate, 11 g of sodium metabisulfite, 4.7 g of a 50% solution of sodium hudroxide and sufficient water and acid or base to make 1L of solution at a pH 6.5.

After processing as described above, the status M red, green, and blue densities of all four samples were determined as a function of incident exposure. The absolute sensitivities of all four samples were then determined from this density as a function of exposure information following International Standards Organization protocols as known in the art. All four samples exhibited excellent linear densitometry in all color records and a photographic sensitivity in excess of ISO-25 under these processing conditions. Additionally all samples were fully desilvered under these processing conditions.

COMPARATIVE ASSESSMENT OF FILM MODULATION TRANSFER FUNCTION RESPONSE EXAMPLE 3

This example illustrates the excellent sharpness attainable from photographic samples of the invention.

Photographic Samples 1–4 were exposed using white light to 60% modulated sinusoidal patterns following the procedure described by R. L. Lamberts and F. C. Eisen, "A System for the Automated Evaluation of Modulation Transfer Functions of Photographic Materials", in The Journal of Applied Photographic Engineering, Vol. 6, pages 1–8, February 1980. A more general description of the determination and interpretation of MTF Percent Response curves can be found in the articles cited within this reference. The samples were then processed as in Example 2 above, and the Modulation Transfer Function (MTF) Percent Response in the green density record as a function of spatial frequency in the film plane were determined. Higher values of MTF Percent Response indicate the presence of a sharper image. The results of this evaluation are listed in Table I.

| Photographic Sample | 5 lines/mm | 15 lines/mm | 25 lines/mm |
|---|---|---|---|
| 1 - control (all 111 grains) | 111% | 123% | 97% |
| 2 - invention (111 & 100 grains) | 121% | 136% | 140% |
| 3 - invention (111 & 100 grains) | 118% | 129% | 128% |
| 4 - control (all 100 grains) | 110% | 118% | 111% |

As is readily apparent from the comparative data listed in Table I, the photographic elements formulated according to the invention, that is, those which employ both {111} faced high chloride tabular banded grain emulsions and {100} faced high chloride grain emulsions, show a marked increase in MTF percent response at visually significant spatial frequencies when compared to the closest art samples, that is, samples which employ only {111} type or only {100} type high chloride grains. The improved MTF percent response makes elements according to the current invention especially useful for application in Limited Use Cameras as described in allowed, commonly assigned, U.S. patent application Ser. No. 135,700 filed Oct. 13, 1993. These improvements in sharpness are noticeable to more than 90% of viewers when 135 size negatives are printed to 4'×6', 8'×10', or 16'×20' prints. The large improvement at 25 lines/mm is particularly important for large prints.

PREPARATIVE AND COMPARATIVE PHOTOGRAPHIC ELEMENT AND PROCESS EXAMPLE 4

This example illustrates the preparation of control Sample 101 comprising a {111}-faced high chloride tabular grain emulsion lacking the bromide or iodide band required in the practice of this invention and which retains the organic grain growth modifier and surface stabilizer required for both formation and morphological stabilization of the grain surface. It also illustrates the preparation of control Sample 102 comprising a {111}-faced high chloride tabular grain emulsion comprising the bromide or iodide band required in the practice of this invention and from which the organic grain growth modifier has been removed. It further illustrates the improved desilvering observed with elements employing the {111} faced emulsions useful in the practice of this invention.

Sample 101 and 102 were each prepared by applying to a transparent support:

a) an antihalation layer comprising grey silver and gelatin;

b) an emulsion layer comprising a chemically and spectrally sensitized {111} faced high chloride emulsion as described below, a cyan dye-forming image coupler, and gelatin; and c) a hardened overcoat layer comprising gelatin and surfactants.

Sample 101 comprised a chemically and spectrally sensitized AgCl{111}-faced tabular grain emulsion having an average equivalent circular diameter of about 1.1 microns and an average grain thickness of about 0.09 microns, which was prepared in the presence of 4,5,6-triaminopyrimidine as grain growth modifier and which retained the 4,5,6-triaminopyrimidine as a grain surface stabilizer following the directions given by Maskasky.

Sample 102 was like Sample 101 except that the emulsion was replaced by a like sized chemically and spectrally sensitized AgClI{111}-faced tabular grain emulsion comprising about 0.5 mole percent iodide as a band with the remainder of the emulsion halide being chloride. The emulsion was prepared using 7-azaindole as the grain growth modifier, and the 7-azaindole was removed by washing before the emulsion was applied to form Sample 102. This emulsion is useful in the practice of the present invention.

Samples 101 and 102 were exposed to white light through a graduated density test object, developed and then desilvered using BLEACH-FIX for 45 seconds at ca 38° C. followed by a water wash and drying.

BLEACH-FIX was prepared by adding to water, 80 mL of a 58% aqueous solution of ammonium thiosulfate, 7.5 g of sodium sulfite, 75 mL of a 44% aqueous solution of Ammonium Ferric Ethylenediamine Tetraacetic Acid and enough water, acid, or base to make 1L of solution with a pH of ca 6.2.

After drying the residual silver and silver halide retained in both samples was measured using X-ray fluorescence. Sample 101 retained 14% more silver than did Sample 102 under these conditions, thus demonstrating the disadvantage of the widely known {111} high chloride emulsions lacking the bromide or iodide band structure and retaining the grain growth modifier or morphological stabilizer for use in the practice of the current invention compared to the {111} with bromide or iodide bands and the modifiers and stabilizers removed.

PREPARATIVE AND COMPARATIVE PHOTOGRAPHIC ELEMENT AND PROCESS EXAMPLE 5

This example illustrates the excellent desilvering properties of elements comprising {111} faced high chloride tabular grain emulsions comprising a bromide or iodide band and useful in the practice of the current invention. Multilayer Multicolor Photographic Sample 5 was prepared generally like Photographic Sample 1 above except for minor adjustments in the quantities of the DIR and Masking couplers. This sample was exposed and processed as in Example 4 above. The sample retained about 2.0 percent of the coated silver. Multilayer multicolor Photographic Sample 6 was prepared generally like Photographic Sample 5 except that the {111}-faced high chloride tabular grain emulsions were replaced by {111}-faced AgIBr emulsions prepared following the teaching of Kofron. This sample was also exposed and processed as in Example 4 above. The photographic sample comprising the {111}-faced iodobromide tabular grain emulsions retained about 13.0 percent of the coated silver. This comparison illustrates the greatly improved desilvering achievable in photographic samples employing {111} high chloride banded structure tabular grain emulsions useful in the practice of the current invention.

The invention has been described in detail with particular reference to preferred embodiments thereof, but it will be understood that variations and modifications can be effected within the spirit and scope of the invention.

I claim:

1. A light sensitive photographic element comprising a support, and chemically and spectrally sensitized emulsions (A) and (B), wherein:

emulsion (A) comprises a tabular silver halide emulsion population comprised of at least 50 mole percent chloride, based on silver, wherein at least 50 percent of the grain population projected area is accounted for by tabular grains bounded by {111} major faces, each having an aspect ratio of at least 2 and each being comprised of a core and a surrounding band containing a higher level of bromide or iodide ion than is present in said core, said band containing up to about 30 percent of the silver in the tabular grain;

wherein said emulsion (A) has been precipitated in the presence of an organic grain growth modifier or surface stabilizer and wherein said organic grain growth modifier or surface stabilizer has been substantially removed from said emulsion (A) after the formation of said band; and emulsion (B) comprises at least 50 mole percent chloride, based on silver, and is bounded by {100} major faces.

2. The element of claim 1 comprising a red light-sensitive color record comprised of at least one red sensitized silver halide emulsion, a green light-sensitive color record comprised of at least one green sensitized silver halide emulsion, and a blue light-sensitive color record comprised of at least one blue sensitized silver halide emulsion.

3. The element of claim 1 wherein the ratio of emulsion (A) to emulsion (B) is between about 95:5 and 5:95 and wherein emulsion (A) and emulsion (B) together comprise at least 50 mole percent of the silver halide in said element.

4. The element of claim 1 wherein emulsions (A) and (B) are spectrally sensitized to different regions of the electromagnetic spectrum.

5. The element of claim 1 wherein emulsions (A) and (B) are sensitized to the same color.

6. The element of claim 1 wherein emulsion (A) and emulsion (B) are sensitized to different colors.

7. The element of claim 5 wherein emulsion (A) and emulsion (B) differ in light sensitivity.

8. The element of claim 1 wherein emulsion (B) comprises a silver halide emulsion population comprised of at least 50 mole percent silver chloride, based on silver, wherein at least 10 percent of the grain population projected area is accounted for by tabular grains bounded by {100} major faces having an adjacent edge ratio of less than 10 and having an aspect ratio greater than 2.

9. The element of claim 1 wherein emulsion (B) comprises no more than about 2 mole percent iodide, based on silver.

10. The element of claim 1 wherein emulsion (B) comprises silver halide grains having a core and a surrounding band containing a higher level of bromide or iodide ion than is present in said core, said band containing up to about 30 percent of the silver in the grain.

11. The element of claim 1, wherein the total chloride content of all the silver halide emulsions is at least 50 mole percent based on silver.

12. The element of claim 1 wherein the total iodide content of all the silver halide emulsions is no more than about 5 mole percent based on silver.

13. The element of claim 1 having a light sensitivity of at least ISO-25.

14. The element of claim 1 comprising a compound selected from the group consisting of: a dye releasing compound, a development inhibitor releasing compound, a bleach accelerator releasing compound, and a color masking compound.

15. The element of claim 1 wherein the element is a color negative element.

16. The element of claim 1 wherein the support is a transparent support.

17. The element of claim 1 wherein the support carries a magentic recording layer.

18. The element of claim 1 comprising between about 1 and 10 grams of silver per square meter.

19. The element of claim 2 wherein each light sensitive color record comprises an emulsion selected from the group consisting of emulsion (A) and emulsion (B).

20. A photographic element comprising emulsion (A) and emulsion (B) wherein emulsion (A) comprises tabular grains of greater than 50 percent chloride bounded by {111} major faces, and emulsion (B) comprises tabular grains of greater than 50 percent chloride bounded by {100} major faces.

21. The element of claim 20 wherein emulsion (A) and emulsion (B) contain at least 95 mole percent silver chloride.

22. The element of claim 20 wherein said emulsion (A) contains a band of silver iodide near the surface of the grains of said emulsion.

23. The element of claim 20 wherein said element is substantially free of organic grain growth modifier and surface stabilizer.

24. A color image forming process comprising the step of contacting an imagewise exposed light sensitive photographic element with a developing solution:

said element comprising emulsion (A) and emulsion (B) wherein emulsion (A) comprises tabular grains of greater than 50 percent chloride bounded by {111} major faces, and emulsion (B) comprises tabular grains of greater than 50 percent chloride bounded by {100} major faces;

the contact time of said element with said developing solution is between about 10 and 120 seconds; and said developing solution is characterized in that:

(1) the solution temperature is between about 25° and 65° C.;

(2) the solution comprises bromide ion at a concentration of between about 0.25 and 50 mmol per liter;

(3) the solution comprises a color developing agent at a concentration between about 1 and 200 mmol per liter;

(4) the ratio of developing agent concentration to bromide ion concentration is between about 60:1 and 1:2; and (5) the solution pH is between about 9 and 12.

* * * * *